US005530763A

United States Patent [19]

Aebi et al.

[11] Patent Number: 5,530,763

[45] Date of Patent: Jun. 25, 1996

[54] HEARING AID TO BE WORN IN THE EAR AND METHOD FOR ITS MANUFACTURE

[75] Inventors: Walter Aebi, Utzensdorf; Elmar Mock, Biel; Grégoire Iten, Düdingen, all of Switzerland

[73] Assignee: Ascom Audiosys AG, Flamatt, Switzerland

[21] Appl. No.: 258,259

[22] Filed: Jun. 10, 1994

[30] Foreign Application Priority Data

Jun. 11, 1993 [CH] Switzerland ..... 01 757/93

[51] Int. Cl.[6] ..... H04R 25/00

[52] U.S. Cl. ..... 381/69; 381/68; 381/68.6

[58] Field of Search ..... 381/68.6, 69, 69.2, 381/68, 68.7, 68.3, 68.5, 69.1; 181/129, 130, 135, 132

[56] References Cited

U.S. PATENT DOCUMENTS

| | | | |
|---|---|---|---|
| 4,739,512 | 4/1988 | Hartl et al. | 381/68.6 |
| 4,987,597 | 1/1991 | Haerti | 381/69 |
| 5,006,055 | 4/1991 | Lebisch et al. | 425/2 |
| 5,068,902 | 11/1991 | Ward | 381/68.6 |
| 5,131,411 | 7/1992 | Casali et al. | 128/864 |
| 5,321,757 | 6/1994 | Woodfill, Jr. | 381/68 |

FOREIGN PATENT DOCUMENTS

| | | |
|---|---|---|
| 2667500 | 4/1992 | France . |
| 2203379 | 10/1988 | United Kingdom . |

*Primary Examiner*—Curtis Kuntz
*Assistant Examiner*—Huyen D. Le
*Attorney, Agent, or Firm*—Walter C. Farley

[57] ABSTRACT

A hearing aid has a skeleton, with an outer support element (3), an inner support element (4) and a connecting element (5), on which are arranged at least part of the electronic components (41, 42) of the hearing aid. The two support elements essentially form the end faces (IS, AS) of an irregular frustum. To the support elements is fixed a diaphragm (2) in such a way that it essentially forms the circumferential surface of the frustum. The diaphragm (2) and the skeleton (3, 4, 5) together form a substantially tubular molding cavity, in which a shaped member (1) adapted to the individual auditory canal is molded with a hardening molding compound in the ear of the user. Prior to the molding process the skeleton can be roughly adapted to the individual auditory canal by a suitable deformation of the connecting element (5). The diaphragm (2) is not only gas-permeable and liquid-impermeable at right angles to its main surface.

26 Claims, 5 Drawing Sheets

HEARING AID TO BE WORN IN THE EAR AND METHOD FOR ITS MANUFACTURE

FIELD OF THE INVENTION

The invention relates to a hearing aid to be worn in the ear and to a method for its manufacture.

BACKGROUND OF THE INVENTION

Hearing aids to be worn in the ear normally have a microphone directed towards the outside in the ear, a loudspeaker directed towards the interior of the ear, amplifying electronics and a replaceable battery for operation, all said electronic components being located in a shaped member, whose shape is to a greater or lesser extent adapted to the shape of the auditory canal and is worn in the latter. In order that the hearing aid can be comfortably worn and therefore fulfill its function in an optimum manner, various demands are made on the shaped member, which it fulfills to a greater or lesser extent as a function of the construction. These requirements are essentially as follows:

- The shaped member must fit well in the auditory canal, so that it has a good position and is still comfortable.
- The shaped member must be easily insertable into and removable from the auditory canal.
- The shaped member must permit pressure compensation in the auditory canal, despite its good fit.
- The shaped member must prevent feedback of the sound produced by the loudspeaker to the microphone.
- The shaped member must be skin-compatible, must in particular permit ventilation of the skin of the auditory canal and must not give rise to the exudation of perspiration and earwax.
- The shaped member must be insensitive to the exudations of the auditory canal and easily cleaned with respect thereto and must in particular protect the electronic components of the hearing aid from such exudations.

Apart from these requirements relating to the function of the hearing aid and its wearing comfort, there are economic requirements to the effect that the shaped member must be easy to manufacture. It could additionally be desirable for economic reasons for the electronic components to be accessibly integrated into the hearing aid, so that they can be replaced.

The above requirements are satisfied to varying degrees by known hearing aids worn in the ear. Some of them will be briefly described and compared with the above list of requirements.

The most frequently used method for the manufacture of hearing aids to be worn in the ear is performed by a hearing aid advisor, who simultaneously investigates the hearing weaknesses of the potential user, and produces a silicone molding or casting of the auditory canal, on the basis of which is produced a transparent, positive model of the auditory canal. From that model is molded a plastics material polymerizable with the aid of light, which hardens from the outside to the inside up to a given layer thickness. This leads to a hollow shaped member, into which the electronic components of the hearing aid are fitted and towards the interior of the ear there is at least one opening for the loudspeaker and for a pressure compensating channel. Adjacent the outlet of the auditory canal the shaped member is closed with a cover, which contains an opening for the pressure compensating channel and a separate compartment for a replaceable battery.

The thus manufactured hearing aid has a shaped member with a very good fit, but which covers the skin of the auditory canal without interruption in such a way that there can be no question of ventilation. This unavoidably leads to increased exudation of perspiration and earwax. The part of the auditory canal left free between the eardrum and hearing aid is open to the outside through the pressure compensating channel, so that pressure compensation can take place and moisture can also escape. However, the pressure compensating channel can increase the feedback between the loudspeaker and the microphone.

A further disadvantage of this hearing aid is that the openings to the loudspeaker and the pressure compensating channel can become easily blocked with earwax and same can also be covered with a liquid-impermeable, but gas-permeable diaphragm, as proposed in European patent application 310,866 (published 12.4.1989).

The described hearing aid manufacturing method is complicated, because the shaped member must be molded in several positive-negative stages and because the manufacturing stages are such that they cannot be performed by the hearing aid advisor. Thus, the manufacturer of the hearing aid must deal with the individual production of user-specific equipment.

In order to simplify the manufacturing methods various proposals have been made. Thus, e.g. according to U.S. Pat. No. 4,962,537, it is proposed that the shaped member be in the form of a double-wall bag of a flexible material, a hardening plastic mass being directly pressed into the user's ear between the two walls. This method saves a few steps in the manufacture, but the molded shaped member must still be reworked, in particular it is necessary to subsequently make openings for a pressure compensating channel and for the loudspeaker and it is doubtful whether this can be done by the hearing aid advisor.

The same applies with respect to the hearing aid according to International patent application W092/03894, whose shaped member is directly molded in the auditory canal.

The two aforementioned manufacturing methods are admittedly simpler than the first-described method, but do not improve the disadvantages with respect to skin contact and feedback. This also applies with regards to the hearing aid of U.S. Pat. No. 4,834,211, in which the shaped member is constituted by a balloon surrounding the electronic components of the hearing aid and which during each insertion into the ear is inflated with a corresponding pump. With such a hearing aid the skin contact and feedback are not improved and there can be no question of simple insertion into the ear.

SUMMARY OF THE INVENTION

An object of the present invention is to provide a hearing aid to be worn in the ear with a shaped member adapted to an individual auditory canal, the hearing aid being improved with respect to the wearing comfort compared with known hearing aids and being manufacturable in a simpler method and in particular being individualizable. In addition, a method is given according to which the hearing aid can be manufactured and in particular individualized.

Briefly described, the method according to the invention is as follows. A general hearing aid, not yet adapted to an individual auditory canal, is mass produced. Preferably, the hearing aid has a skeleton which can be plastically deformable to a limited extent and which carries the electronic components of the hearing aid and to which is fixed a flexible diaphragm in such a way that the skeleton and the diaphragm form a molding chamber, which has a molding channel open to the outside. The hearing aid is then individualized (adapted to an individual auditory canal), by shaping the skeleton to match the individual auditory canal shape. The thus partly individualized hearing aid is positioned in the ear and then the molding chamber is filled with a hardening plastic mass, the diaphragm being deformed and the resulting shaped member being shaped in accordance with the auditory canal. The skeleton and diaphragm are constructed and fixed to one another in such a way that there is no need for any reworking of the hearing aid individualized by skeleton shaping and molding the shaped member.

The material and structure of the diaphragm are such that they are permeable to gases as a result of extremely fine porosity and corresponding surface quality, but impermeable to liquids and that it is sufficiently elastic to be applied in fold-free manner to the auditory canal wall when molding the shaped member. The diaphragm is not only gas-permeable at right angles to its surfaces, but also parallel thereto, so that not only can the air displaced during molding escape through this diaphragm, but it can also serve as a pressure compensating means and for ventilating the auditory canal skin. This effect can be improved in that the diaphragm has on its side facing the skeleton a coarse, porous intermediate layer, which can be a layer of an open-pore foam or a gauze. So that the diaphragm can fulfil its function on a long term basis, it is also water and oil-repellent.

It has been found that a foamed and stretched PTFE diaphragm manufactured under the name GORE-TEX by W.L. Gore & Co. GmbH (D-88011 Putzbrunn bei Munchen) has the necessary characteristics and is suitable for use. It is a foamed and stretched PTFE material (poly-tetrafluoroethylene), which forms a very fine porous diaphragm. This diaphragm not only has the necessary physical characteristics, but is also very friendly to the skin and body (it can be used as a provisional skin in the case of large-surface wounds).

Further suitable diaphragm materials are woven and knitted materials e.g. from plastic fibers, which are coated on at least the surface facing the auditory canal with an oil and water-repellent coating. This coating can e.g. be an evaporation coated coating of Parylen (Union Carbide Corp. USA) or silane.

BRIEF DESCRIPTION OF THE DRAWINGS

The manufacturing method according to the invention and the hearing aid manufactured according to this method are described in greater detail hereinafter with reference to embodiments shown by way of example in the attached drawings, wherein.

FIGS. *5a*, *5b* and *5c* are schematic perspective views showing the steps in three different methods for manufacturing a diaphragm bag for the hearing aid according to the invention.

DESCRIPTION OF THE PREFERRED EMBODIMENTS

Figure 1:
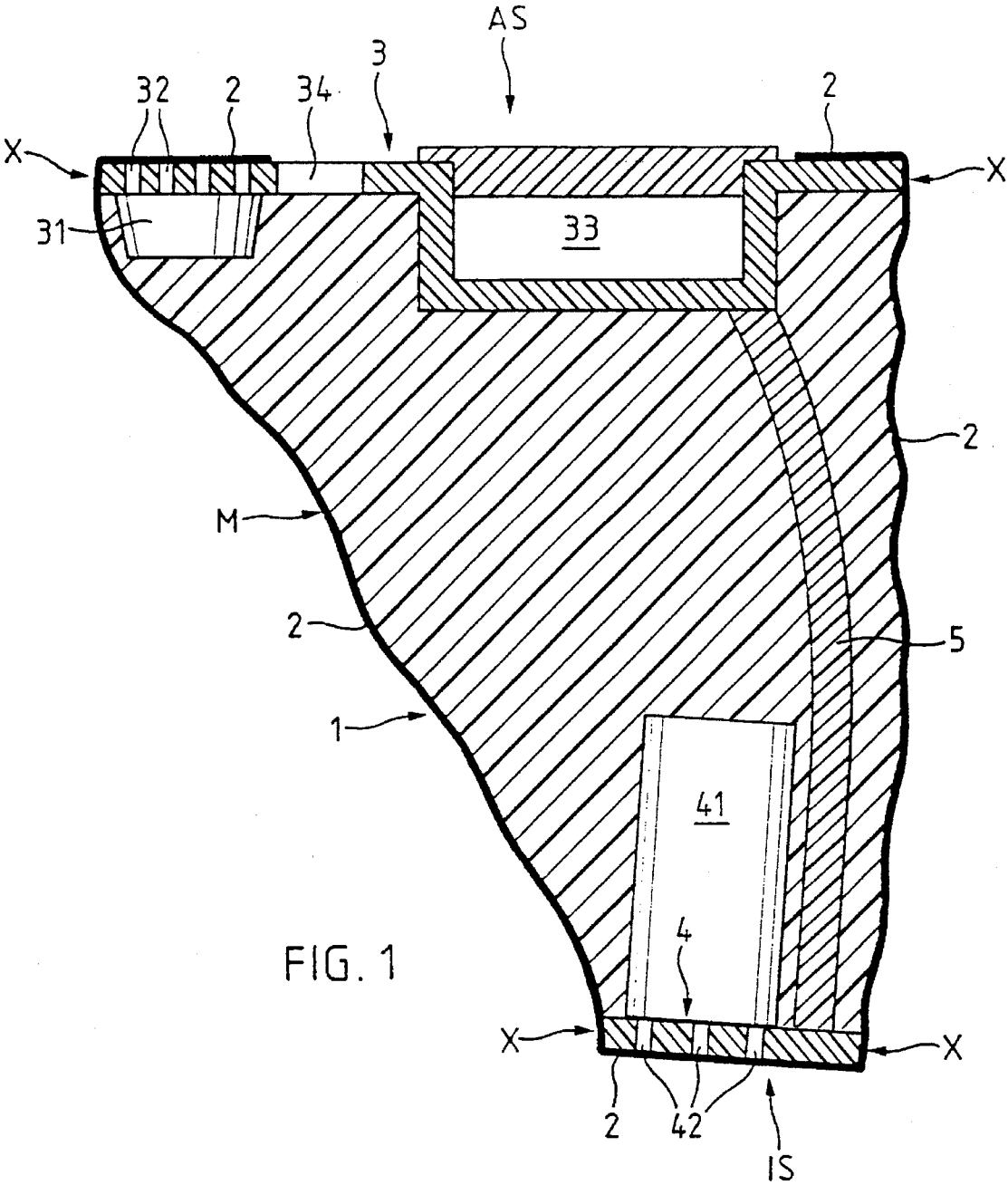
FIG. 1 is a sectional view in a plane parallel with the auditory canal axis of the most important parts of the hearing aid according to the invention for explaining their functions.

FIG. 1 shows the principle of the hearing aid according to the invention in a highly schematic manner. The hearing aid is already in its individualized state and is shown in section parallel to the auditory canal axis. It is substantially shaped like an irregular frustum with a circumferential surface M, a larger end face AS directed towards the outside in the auditory channel and a smaller end face IS directed towards the inside in the auditory channel.

The hearing aid essentially comprises a shaped member 1, whose shape is adapted to the auditory canal and at least on the circumferential surface M, i.e. where it contacts the auditory canal wall when the aid is being worn, is covered with a diaphragm 2. The hearing aid also has a skeleton, which essentially comprises three parts, namely an outer support element 3, which essentially forms the outer end face AS of the aid, an inner support element 4, which essentially forms the inner end face of the aid and a connecting element 5, which interconnects the two support elements 3 and 4. The connecting element 5 serves to keep the two support elements 3 and 4 in their spaced relative positions prior to the molding of the shaped member and this roughly corresponds to an auditory canal. The connecting element 5 is advantageously deformable to a limited extent, so that as a first individualizing stage the relative positions of the support elements 3 and 4 can be adapted to the individual auditory canal.

The outer support element 3 carries a microphone 31 for which it is provided at the corresponding point with sound passage openings 32. The outer support element 3 also forms a closable battery compartment 33 and carries a pouring or injecting opening 34. The inner support element 4 carries a loudspeaker 41 and is also provided with sound passage openings 42.

The diaphragm 2, which at least surrounds the shaped member on its circumferential surface M, is fixed to the two support elements around the two end faces AS and IS (points X in the drawing). The diaphragm 2 can additionally cover entirely the inner end face IS. It can also partly cover the outer end face, but must leave freely accessible the pouring and injecting opening 34 and the battery compartment 33.

The amplifier electronics (not shown) can either be carried by one of the support elements or by the connecting element. It can also be molded into the shaped member without any special fastening to the skeleton. The skeleton is advantageously made from plastic. The diaphragm can be fixed to the support elements, e.g. by welding, bonding or suitable securing members. Further fastening possibilities will be described in conjunction with FIGS. 2 to 4.

The general hearing aid, from which is produced the individualized hearing aid schematically shown in FIG. 1, differs from the latter in that the shaped member 1 is only present as a still undefined molding cavity between the support elements and the diaphragm. The diaphragm 2 fixed to the support elements 3 and 4 consequently loosely surrounds the skeleton and forms with the support elements a molding chamber surrounding in tubular manner the skeleton and which is open to the outside through the molding channel 34.

The molding chamber between the diaphragm and the skeleton is filled by a suitable plastics material through the molding channel 34, the hearing aid being positioned in the auditory canal. The plastic hardens to the individualized shaped member 1. The requirements made on the plastics material are that it can easily be poured through the molding channel and that it rapidly hardens, while obviously being skin-compatible.

It has been found that the molding compound based on vinyl polysiloxane and which is more particularly used in dental technology and which is manufactured under the name Imprint by 3M is very suitable for the present purposes. This two-component molding component is obtainable in easily handleable twin cartridges with cannulas, which can be directly mounted on the molding channel 34.

It is obviously also possible to use other molding compounds. Advantageously use is made of those materials, which do not split off low-molecular weight radicals during polymerization. Additives, e.g. small foam bodies or hollow glass balls can be added to the molding compound for improving the characteristics of the shaped member as a sound and vibration absorber.

During the molding process and particularly during its final phases when the shaped member already firmly engages on the auditory canal, pressure compensation takes place through the diaphragm and the intermediate layer, if provided, parallel to the main faces thereof, so that no pressure can build up through the molding in the auditory canal closed by the shaped member.

The manufacture of the hearing aid diagrammatically shown in FIG. 1 e.g. involves the following stages:

Produce the skeleton, e.g. by injection molding of a suitable plastic. Install the loudspeaker 41, microphone 31 and amplifier electronics on the skeleton, electrically interconnect them and connect to the battery compartment 33.

Surround the skeleton with the diaphragm 2 and fix the latter to the support elements 3 and 4 (points X). Approximately adopt the general hearing aid manufactured in the first three stages to an individual auditory canal by suitable deformation of the skeleton or connecting element 5. Position the roughly adapted hearing aid in the auditory canal and produce the shaped member by filling the molding chamber between the diaphragm and the skeleton. Insert the battery.

The stages necessary for individualizing the general hearing aid are the deformation of the skeleton and the molding of the shaped member. Both stages can easily be performed by the hearing aid advisor, in such a way that the user can take away the hearing aid following one session and the manufacturer only has to produce general hearing aids.

Figure 2:
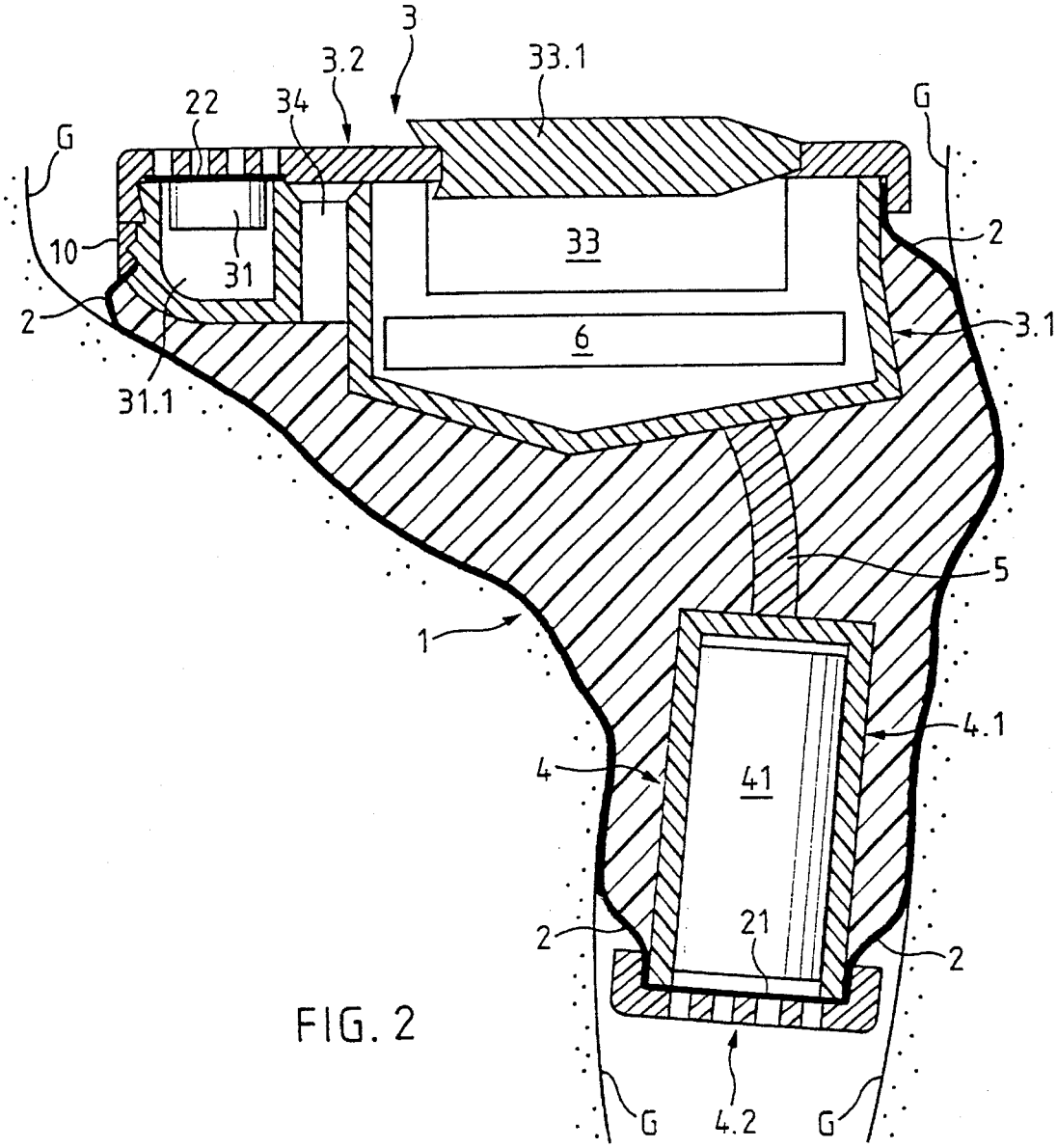
FIG. 2 is a sectional view similar to FIG. 1 of an embodiment of the individualized hearing aid according to the invention.
Figure 3:
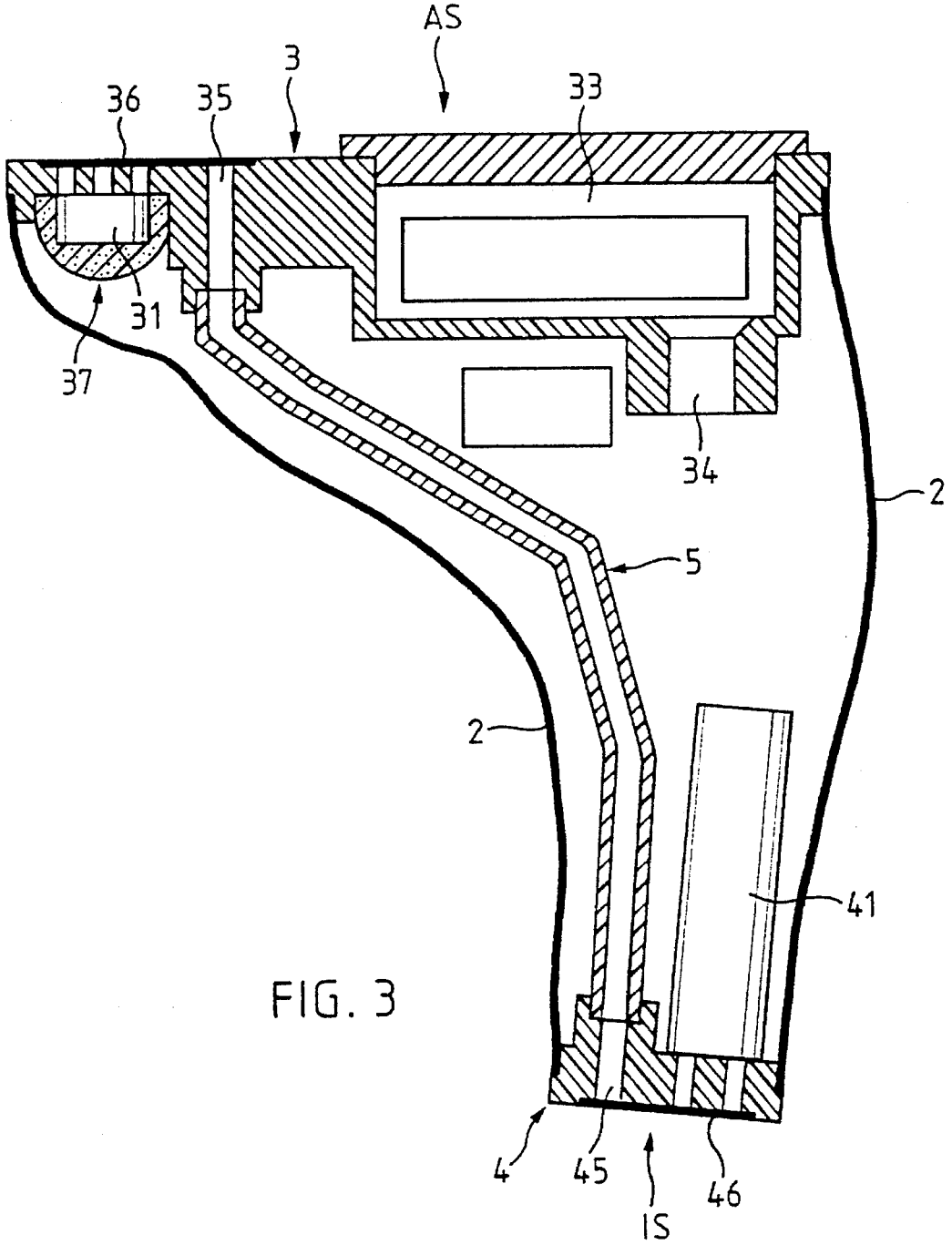
FIGS. 3 and 4 are further embodiments of the hearing aid according to the invention before molding the shaped portion to match an individual's ear canal.
Figure 4:
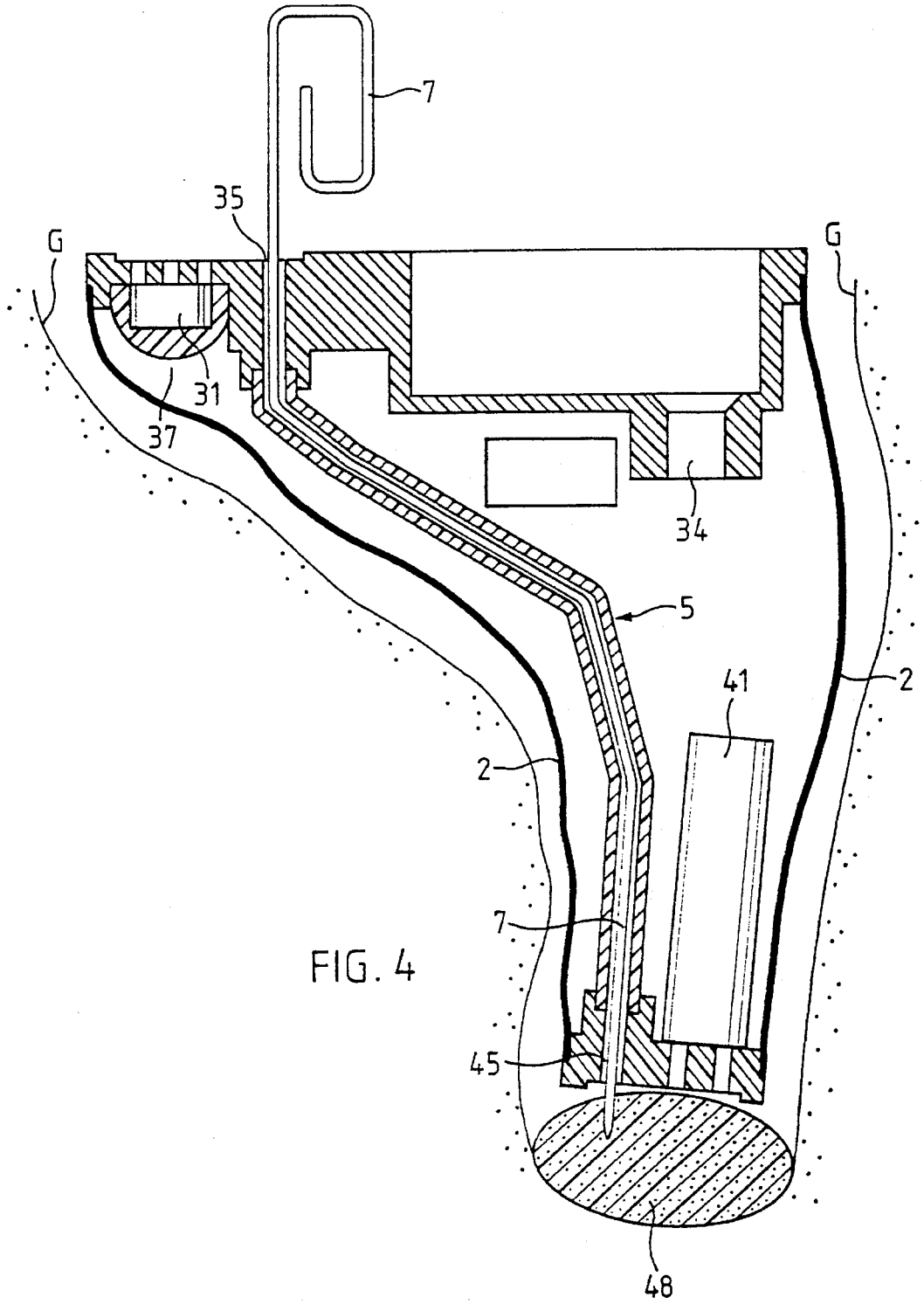

The embodiments of the hearing aid according to the invention shown in FIGS. 2 to 4 differ from one another essentially in that the electronic components are accessible to different degrees. The principle described relative to FIG. 1 is retained in all the embodiments.

FIG. 2 shows a first embodiment of the hearing aid according to the invention once again in section parallel to the auditory canal axis. The aid is positioned in an auditory canal, the auditory canal walls being indicated by the lines G. The represented hearing aid is already individualized. It has a skeleton, which in turn comprises an outer support element 3, an inner support element 4 and a connecting element 5 and which carries the electronic components. This skeleton is located in a molded shaped member 1, whose surface directed towards the auditory canal is covered by a bag-like diaphragm 2.

The two support elements 3 and 4 are constructed as an inner capsule 4.1 with an inner closing element 4.2 and an outer capsule 3.1 with an outer closing element 3.2, which permits an at least partial accessibility to the electronic components in the individualized hearing aid.

The inner capsule 4.1 houses the loudspeaker 41, which is introduced through its opening before the closing element 4.2 is engaged thereon. In suitably arranged compartments in the outer capsule 3.1 are advantageously housed the microphone 31 in a microphone compartment 31.1 and a battery in a battery compartment 33. The amplifier electronics 6 can also be housed in the outer capsule 3.1. The electrical connections between the electronic components of the hearing aid e.g. run through the deformable connecting element 5.

The molding channel 34, which is open to the outside, is e.g. shaped onto the outer capsule 3.1. The openings of the individual compartments of the outer capsule 3.1 and the opening of the molding channel 34 are substantially located in one plane, so that they can be jointly closed by the closing element 3.2. However, it is also possible to provide separate closing elements for the different openings or for certain of the openings to design partial areas of the common closing element 3.2 in such a way that they can be opened and closed, without having to open the entire closing element 3.2. In FIG. 2 the battery compartment 33 is closed with such a partial closing element 33.1 and is therefore very readily accessible to the user.

The bag-like diaphragm 2 has a main opening, whose edge is so fixed around the area in which are located the opening of the outer capsule 3.1 and the opening of the molding channel 34, that the entire skeleton except for the opening of the molding channel 34 and the opening of the outer capsule 3.1 is embraced by the diaphragm 2. The fixing of the diaphragm 2 around the outer capsule is brought about by an outer diaphragm fixing means, which can e.g. comprise a fixing ring 10 positively arranged around the outer capsule (on the left-hand side of the drawing) or by a suitable positive design of the marginal areas of the closing element 3.2 (on the right-hand side of the drawing). If the diaphragm 2 is fixed by the closing element 3.2 to the outer capsule 3.1, in the manner shown in the drawing for the battery compartment 33, the closing element 3.2 must have for the molding channel 34 a removable partial area or at least one opening.

Around the opening of the inner capsule 4.1 the diaphragm 2 is fixed with an inner diaphragm fixing means and, as shown, covers the loudspeaker opening or can have in said area a further opening. The inner diaphragm fixing means is e.g. the perforated, inner closing element 4.2 positively fitting onto the opening of the inner capsule 4.1 and which secures the diaphragm 2 around the opening of the capsule 4.1 in such a way that the molding compound cannot enter the opening, that the part 21 covering the capsule opening mechanically protects the diaphragm 2 in use and does not constitute an obstacle for the sound of the loudspeaker (sound passage openings).

That part of the opening of the outer capsule 3.1 located above the microphone compartment 31.1 can also be covered with a diaphragm. As shown in FIG. 1, it can be in the form of a separate diaphragm portion 22 secured between the closing element 4.2 and the capsule wall, or in such a way that the diaphragm 2 engages in one piece over the said opening and is held in the same way as on the opening of the inner capsule 3.1. The closing element 3.2 is advantageously perforated in the area covering the microphone compartment 3.1. As stated, the diaphragm 2 can also be welded or bonded to the capsules or the corresponding closing elements.

FIGS. 3 and 4 show another embodiment of the hearing aid according to the invention. The principle once again corresponds to that described in conjunction with FIG. 1 and the main components of the hearing aid also correspond thereto, so that there is no need to give another description thereof. The difference compared with the hearing aids of FIGS. 1 and 2 is that the connecting element is hollow and serves as a pressure compensating channel, issuing openings 45, 35 being provided in the inner support element 4 and the outer support element 3. The pouring opening 34 is also arranged in such a way that it issues into the battery compartment 33. The inner end face IS is covered with a separate diaphragm portion 46, the area of the microphone 31 and the outer issuing opening 45 of the pressure compensating channel also being covered with a separate diaphragm portion 36. The molding compound is molded directly around the microphone 31 and the loudspeaker 41 or they can be surrounded on the shaped member side with a sound insulating material 37.

FIG. 3 shows the hearing aid in the general state as supplied by the manufacturer.

FIG. 4 shows the hearing aid in the auditory canal G ready for molding. In order to keep the pouring or molding opening 34 free, the battery and battery compartment cover are removed. In order to free the issuing openings 35,45 of the pressure compensating channel, the separate diaphragm portions 36 and 46 (FIG. 3) are removed and to the inner end face IS of the hearing aid is fitted a protective element, secured with a wire 7 through the pressure compensating channel. The protective element not only protects the eardrum during molding, but is also intended to assist the positioning of the not yet individualized hearing aid in the auditory canal. The protective element 48 is e.g. made from foam. The wire 7 carrying the protective element can additionally serve as an aid for the insertion of the hearing aid into the auditory canal and for the removal thereof.

Prior to molding, i.e. in the general state of the hearing aid, the diaphragm must already have a shape roughly corresponding to the auditory canal, so that it surrounds in fold-free manner the shaped member in the individualized state of the hearing aid. In particular it must be fixable with the minimum of folds or creases around its main opening (outer end face) and around the opening on the inner end face. For this purpose the diaphragm must be present in the form of a bag tapering away from the main opening. Such a diaphragm bag can be produced in numerous different ways, as shown in FIGS. 5*a* to 5*c*.

Figure 5A:
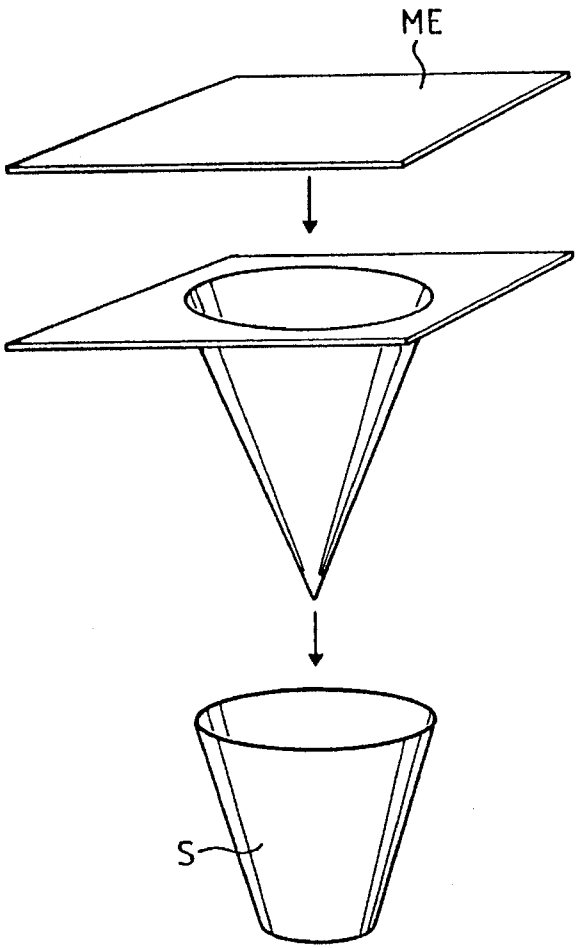

In the case of adequate diaphragm deformability such a bag S, as shown in FIG. 5*a*, can be drawn from a flat portion ME of a diaphragm. This production procedure requires adequate deformability of the diaphragm, but is advantageous if the inner end face of the hearing aid is to be covered by the diaphragm, i.e. if the diaphragm bag is only to have a main opening, but no further opening.

Figure 5B:
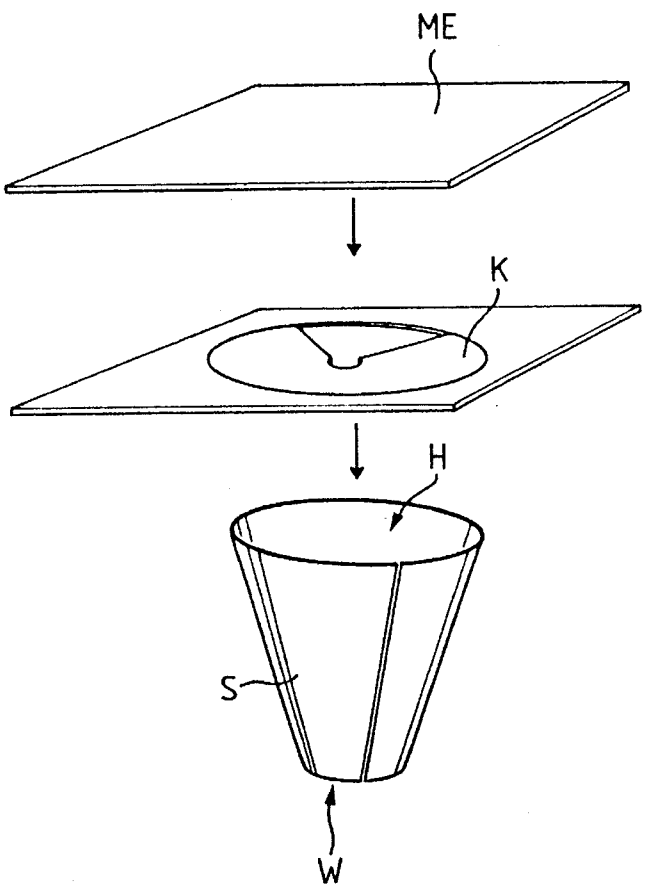

FIG. 5*b* shows a method for the manufacture of a diaphragm bag S from a flat diaphragm portion ME, from which has been cut a piece K in the form of a developed frustum jacket. This piece K is welded to the diaphragm bag S with a main opening H and a further opening W.

Figure 5C:
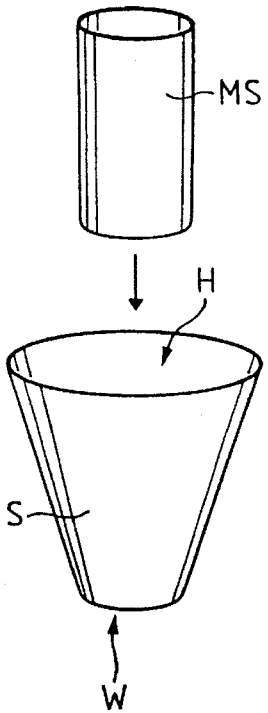

FIG. 5*c* shows the manufacture of a diaphragm bag with a main opening H and a further opening W from a piece of diaphragm hose MS by widening its one end to a larger diameter.

In order to assist the gas exchange in the direction of the main faces of the diaphragm it is possible, as stated, to draw it onto a second layer (intermediate layer), which is located between the diaphragm and the shaped member on the finished hearing aid, i.e. does not come into contact with the skin of the auditory canal. As stated, said layer can be an open-pore foam or a gauze onto which the diaphragm is drawn. It has been found that such an intermediate layer can also facilitate the manufacture of the diaphragm bag.

We claim:

1. A hearing aid having an outer surface in the shape of an irregular conical frustum and adapted to be shaped to the conformation of an individual patient's auditory canal, the hearing aid comprising the combination of a skeleton including an outer support element forming an outer end face of the frustum, an inner support element forming an inner end face of said frustum and a connecting element interconnecting and maintaining said support elements in spaced relationship, said outer support element having a pouring opening;

electronic hearing enhancement means carried at least partly by said skeleton; and a tubular, microporous, elastic diaphragm comprising a material which is permeable to gases, impermeable to liquids and is oil repellent, said diaphragm being attached at opposite ends to said inner and outer support elements and forming an outer surface of said frustum;

said support elements, said connecting element and said diaphragm defining an interior volume within said diaphragm comprising a molding cavity adapted to receive a hardenable material through said pouring opening.

2. A hearing aid according to claim 1 wherein said material of said diaphragm is foamed and stretched polytetrafluoroethylene.

3. A hearing aid according to claim 2 and further comprising an intermediate layer on an inner surface of said diaphragm.

4. A hearing aid according to claim 3 wherein said intermediate layer comprises an open-pore foam or a gauze.

5. A hearing aid according to claim 1 wherein said material of said diaphragm is woven or knitted from plastic fibers and is coated on at least one side with a water- and oil-repellent coating.

6. A hearing aid according to claim 5 and further comprising an intermediate layer on an inner surface of said diaphragm.

7. A hearing aid according to claim 6 wherein said intermediate layer comprises a open-pore foam or a gauze.

8. A hearing aid according to claim 1 wherein at least one of said inner and outer support elements comprises a capsule with a closing element.

9. A hearing aid according to claim 1 wherein said diaphragm is attached to said support elements by welding, bonding or a mechanical attachment means.

10. A hearing aid according to claim 9 wherein said connecting element is plastically deformable.

11. A hearing aid according to claim 1 wherein said connecting element has a hollow interior volume and said inner and outer support elements comprise openings communicating with said hollow interior volume, whereby said connecting element and said support elements form a pressure compensating channel.

12. A hearing aid having an outer surface in the shape of an irregular conical frustum conforming to an individual patient's auditory canal and comprising the combination of a skeleton including an outer support element forming an outer end face of the frustum, an inner support element forming an inner end face of said frustum and a connecting element connecting said support elements, said outer support element having an opening therethrough;

electronic hearing enhancement means carried at least partly by said skeleton;

a tubular, microporous, elastic diaphragm comprising a material which is permeable to gases, impermeable to liquids and is oil repellent, said diaphragm being attached at opposite ends to said inner and outer support elements and forming an outer surface of said frustum; and a shaped member molded from a hardenable material and confined within a volume defined by said support elements, said connecting element and said diaphragm.

13. A hearing aid according to claim 12 wherein said shaped member comprises vinyl polysiloxane.

14. A hearing aid according to claim 12 wherein said shaped member comprises an additive for improving absorbing characteristics.

15. A hearing aid according to claim 14 wherein said additive is foam pieces or hollow glass or plastic balls.

16. A hearing aid according to claim 12 wherein at least one of said end faces is at least partly covered by said diaphragm.

17. A hearing aid according to claim 12 wherein said material of said diaphragm is foamed and stretched polytetrafluoroethylene.

18. A hearing aid according to claim 12 and further comprising an intermediate layer on an inner surface of said diaphragm.

19. A hearing aid according to claim 18 wherein said intermediate layer comprises a open-pore foam or a gauze.

20. A hearing aid according to claim 12 wherein said material of said diaphragm is woven or knitted from plastic fibers and is coated on at least one side with a water- and oil-repellent coating.

21. A hearing aid according to claim 20 and further comprising an intermediate layer on an inner surface of said diaphragm.

22. A hearing aid according to claim 21 wherein said intermediate layer comprises a open-pore foam or a gauze.

23. A hearing aid according to claim 12 wherein at least one of said inner and outer support elements comprises a capsule with a closing element.

24. A hearing aid according to claim 12 wherein said diaphragm is attached to said support elements by welding, bonding or a mechanical attachment means.

25. A method of adapting the exterior shape of a hearing aid to the conformation of a wearer's auditory canal comprising the steps of providing a hearing aid having a skeleton including an outer support element forming an outer end face of a generally conical frustum, an inner support element forming an inner end face of said frustum and a connecting element connecting said support elements, said outer support element having a pouring opening, electronic hearing enhancement means carried at least partly by said skeleton, and a tubular, microporous, elastic diaphragm comprising a material which is permeable to gases, impermeable to liquids and is oil repellent, said diaphragm being attached at opposite ends to said inner and outer support elements and forming an outer surface of said frustum, said support elements, said connecting element and said diaphragm defining an interior volume comprising a molding cavity adapted to receive a hardenable material through said pouring opening;

positioning the hearing aid in the auditory canal of the wearer, and pressing the hardenable material through the pouring opening into the molding cavity.

26. A method according to claim 25 and including, before the step of pressing the hardenable material, shaping the skeleton approximately to the shape of the auditory canal.

* * * * *